US008350760B2

(12) United States Patent
Lee

(10) Patent No.: US 8,350,760 B2
(45) Date of Patent: Jan. 8, 2013

(54) ANTENNA USING BUILDUP STRUCTURE AND METHOD OF MANUFACTURING THE SAME

(75) Inventor: Ho-Jun Lee, Seongnam-si (KR)

(73) Assignee: Korea Electronics Technology Institute, Seongnam-Si, Gyeonggi-Do (KR)

( * ) Notice: Subject to any disclaimer, the term of this patent is extended or adjusted under 35 U.S.C. 154(b) by 586 days.

(21) Appl. No.: 12/655,058

(22) Filed: Dec. 21, 2009

(65) Prior Publication Data

US 2010/0156744 A1 Jun. 24, 2010

(30) Foreign Application Priority Data

Dec. 24, 2008 (KR) ..... 10-2008-0133871

(51) Int. Cl.
*H01Q 1/38* (2006.01)

(52) U.S. Cl. ..... 343/700 MS; 29/600

(58) Field of Classification Search ..... 343/700 MS, 343/846, 872; 29/600; 340/572.7
See application file for complete search history.

(56) References Cited

U.S. PATENT DOCUMENTS

| | | | | |
|---|---|---|---|---|
| 5,569,879 | A * | 10/1996 | Gloton et al. | 361/782 |
| 6,509,217 | B1 | 1/2003 | Reddy | |
| 6,677,917 | B2 | 1/2004 | Van Heerden | |
| 7,084,770 | B2 * | 8/2006 | Brady et al. | 340/572.7 |
| 7,119,685 | B2 | 10/2006 | Eckstein | |
| 7,126,482 | B2 | 10/2006 | Shoji | |
| 7,416,135 | B2 | 8/2008 | Tanaka | |
| 7,540,428 | B2 | 6/2009 | Baba | |
| 7,583,192 | B2 | 9/2009 | Tuttle | |
| 7,730,606 | B2 * | 6/2010 | Forster et al. | 29/729 |

FOREIGN PATENT DOCUMENTS

| | | |
|---|---|---|
| KR | 10-2006-0020571 | 3/2006 |
| KR | 10-2006-0069305 | 6/2006 |
| KR | 10-0847543 | 7/2008 |

* cited by examiner

*Primary Examiner* — Tan Ho
(74) *Attorney, Agent, or Firm* — Lowe Hauptman Ham & Berner, LLP

(57) ABSTRACT

There are provided an antenna using a buildup structure and a method of manufacturing the same. In the antenna, a tag chip is positioned within a dielectric and is connected to a radiator through a connection line or a via-hole, thereby being strong against external environments, decreasing a defective rate and enabling to be used for the special purpose of being positioned within a metal or liquid.

14 Claims, 3 Drawing Sheets

ANTENNA USING BUILDUP STRUCTURE AND METHOD OF MANUFACTURING THE SAME

CROSS-REFERENCE TO RELATED APPLICATION

This application claims the benefit of Korean Patent Application No. 10-2008-0133871, filed Dec. 24, 2008, the disclosure of which is hereby incorporated herein by reference in its entirety.

BACKGROUND OF THE INVENTION

1. Field of the Invention

The present invention relates to an antenna using a buildup structure and a method of manufacturing the same, and more particularly, to an antenna using a buildup structure wherein a chip is positioned within a dielectric and a method of manufacturing the same.

2. Description of the Related Art

Radio Frequency Identification (RFID) means a system of processing information by, identifying a tag in a thin and flat type which is applied to an object in a contactless manner, using a radio frequency signal. Antennas using RFID tags are practically used in various application fields, such as products, traffic, security and safety, among others.

FIG. 1 is a block diagram illustrating the constitution of a conventional tag antenna. With reference to FIG. 1, the conventional tag antenna comprises: a dielectric 11, a radiator 13, a ground 15, a ground line 17 and a tag chip 19. However, in the conventional tag antenna, the tag chip 19 protrudes as shown in FIG. 1. Therefore, the tag chip 19 is sensitive to an external impact, static electricity, temperature, pressure, humidity and the like, thereby increasing a defective rate and decreasing a recognition rate in actual use.

Due to these problems, a user has to check the state of the tag antenna one by one to confirm whether the tag antenna has no problems before actually using the tag antenna. Moreover, since the tag antenna has limited uses, it cannot be used for the special purpose of being positioned within a metal or liquid.

SUMMARY OF THE INVENTION

Therefore, it is an object of the present invention to provide an antenna using a buildup structure in which a tag chip is positioned within a dielectric, to be strong and durable against external environments and used for the special purpose of being positioned within a metal or liquid, and a method of manufacturing the same.

In accordance with an embodiment of the present invention, there is provided an antenna using a buildup structure, comprising: a dielectric layer consisting of a first dielectric and a second dielectric stacked on the first dielectric; a radiator positioned on an upper surface of the dielectric layer; a ground positioned at an under surface of the dielectric layer; a ground line connecting the radiator and the ground; and a chip positioned within the second dielectric, wherein the dielectric layer includes at least one via-hole and connect input/output terminals of the chip to the radiator.

In the antenna using the buildup structure, the first dielectric and the second dielectric consist of the same material.

In the antenna using the buildup structure, the first dielectric and the second dielectric consist of different materials.

In the antenna using the buildup structure, the via-hole is printed with a conductor.

In the antenna using the buildup structure, the via-hole is filled with a conductor.

In accordance with another embodiment of the present invention, there is provided an antenna using a buildup structure, comprising: a dielectric layer consisting of a first dielectric, a second dielectric stacked on the first dielectric and a third dielectric positioned amid the second dielectric and stacked on the first dielectric; a radiator positioned on an upper surface of the dielectric layer; a ground positioned at an under surface of the dielectric layer; a ground line connecting the radiator and the ground; a chip positioned within the third dielectric; and a connection line connecting the chip and the radiator.

In the antenna using the buildup structure, one or more of the first, second and third dielectrics consist of different materials.

In accordance with another embodiment of the present invention, there is provided a method of manufacturing an antenna using a buildup structure, comprising: a first coating step of applying a first dielectric to an upper surface of a ground formed of a conductor; a stacking step of stacking a chip on an upper surface of the first dielectric; a second coating step of applying a second dielectric to the upper surface of the first dielectric on which the chip is stacked; a third coating step of applying a radiator to an upper surface of the second dielectric; and a formation step of forming a ground line passing through the first and second dielectrics, to connect the radiator and the ground, and forming at least one via-hole passing through the second dielectric, to connect the radiator and input/output terminals of the chip.

In the method of manufacturing the antenna using the buildup structure, the first dielectric and the second dielectric consist of the same material.

In the method of manufacturing the antenna using the buildup structure, the first dielectric and the second dielectric consist of different materials.

In the method of manufacturing the antenna using the buildup structure, the formation step connects the radiator and the input/output terminals of the chip by printing a conductor.

In the method of manufacturing the antenna using the buildup structure, the formation step connects the radiator and the input/output terminals of the chip by filling a conductor.

In accordance with another embodiment of the present invention, there is provided a method of manufacturing an antenna using a buildup structure, comprising: a first coating step of applying a first dielectric to an upper surface of a ground formed of a conductor; a second coating step of applying a second dielectric to an upper surface of the first dielectric; a stacking step of etching a middle part of the second dielectric and stacking a chip on the etched part of the second dielectric; a third coating step of applying a radiator to an upper surface of the second dielectric so that the radiator is connected to a connection line of the chip; a fourth coating step of applying a third dielectric to the part where the chip is stacked; and a formation step of forming a ground line passing through the first and second dielectrics, to connect the radiator and the ground.

In the method of manufacturing the antenna using the buildup structure, one or more of the first, second and third dielectrics consist of different materials.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE PREFERRED EMBODIMENT

The present invention will now be described more fully hereinafter with reference to the accompanying drawings, in which preferred embodiments of the invention are shown so that those of ordinary skill in the art can easily carry out the present invention.

The operating principles according to the embodiments of the present invention will be described in detail. In this regard, where the function and constitution are well-known in the relevant arts, further discussion will not be presented in the detailed description of the present invention in order not to unnecessarily make the gist of the present invention unclear.

Like numbers refer to like elements having like functions and actions throughout the specification and drawings.

Figure 1:
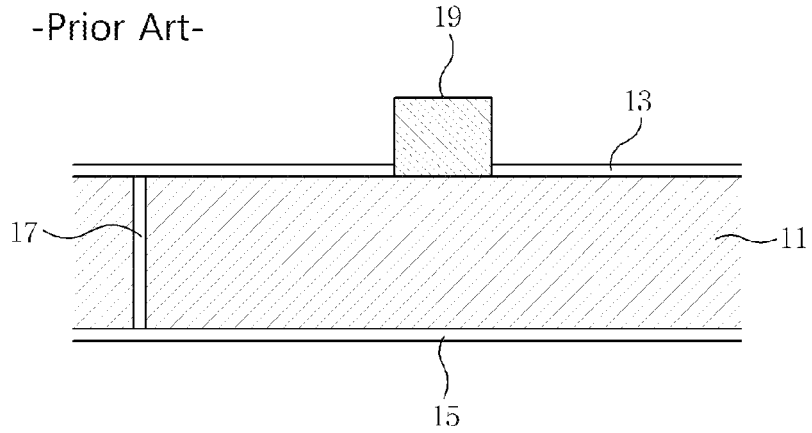
FIG. 1 is a block diagram illustrating a conventional tag antenna.
Figure 2:
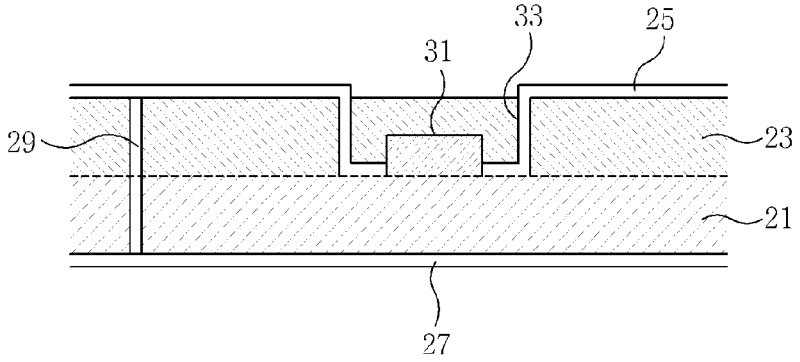
FIG. 2 is a block diagram illustrating an antenna using a buildup structure according to an embodiment of the present invention.

FIG. 2 is a block diagram illustrating an antenna using a buildup structure according to an embodiment of the present invention. With reference to FIG. 2, the antenna using a buildup structure comprises: a first dielectric 21, a second dielectric 23, a radiator 25, a ground 27, a ground line 29, a chip 31 and a via-hole 33.

The second dielectric 23 is stacked on the first dielectric 21. The radiator 25 is positioned on an upper surface of the second dielectric 23. The ground 27 is positioned on an under surface of the first dielectric 21. For example, the first dielectric 21 and the second dielectric 23 may consist of the same material or different materials.

The radiator 25 and the ground 27 are connected to each other by the ground line 29 passing through the first dielectric 21 and the second dielectric 23.

The chip 31 is a tag chip for wireless transmission/reception and positioned within the second dielectric 23. Input/output terminals of the chip 31 are connected to the radiator 25 through the via-hole 33 passing through the second dielectric 23.

Therefore, the chip 31 is not affected by an external impact, static electricity, temperature, pressure, humidity and the like. The antenna using a buildup structure according to the present invention is operable as an antenna, without any malfunction, when it is positioned within a metal or liquid.

The via-hole 33 to connect the radiator 25 and the input/output terminals of the chip 31 may be formed of a printed conductor or a filled conductor.

Figure 3:
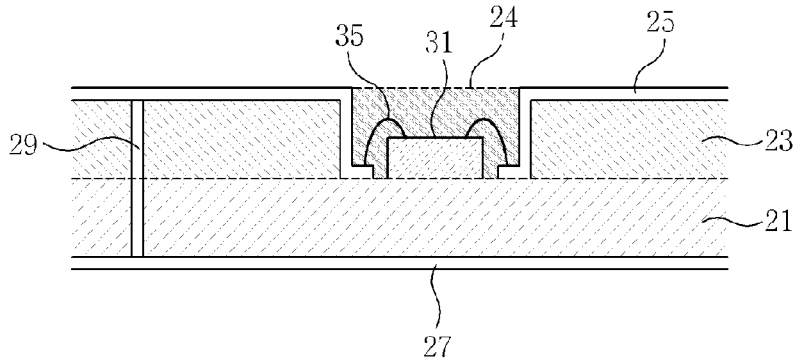
FIG. 3 is a block diagram illustrating an antenna using a buildup structure according to another embodiment of the present invention.

FIG. 3 is a block diagram illustrating an antenna using a buildup structure according to another embodiment of the present invention. With reference to FIG. 3, the antenna using a buildup structure comprises: a first dielectric 21, a second dielectric 23, a third dielectric 24, a radiator 25, a ground 27, a ground line 29, a chip 31 and a connection line 33.

In this embodiment, the radiator 25 and the chip 31 are connected to each other by the connection line 35. Further, the third dielectric 24 surrounding the chip 31 and the connection line 35 is positioned amid the second dielectric 23.

For example, one or more of the first dielectric 21, second dielectric 23 and third dielectric 24 may consist of different materials.

Therefore, the chip 31 is not affected by an external impact, static electricity, temperature, pressure, humidity and the like. Like the antenna according to the embodiment of FIG. 2, the antenna according to the present invention is operable as an antenna, without any malfunction, when it is positioned within a metal or liquid.

A method of manufacturing the antenna using a buildup structure according to the embodiments of the present invention will be described, in more detail, with reference to FIGS. 4 and 5.

Figure 4:
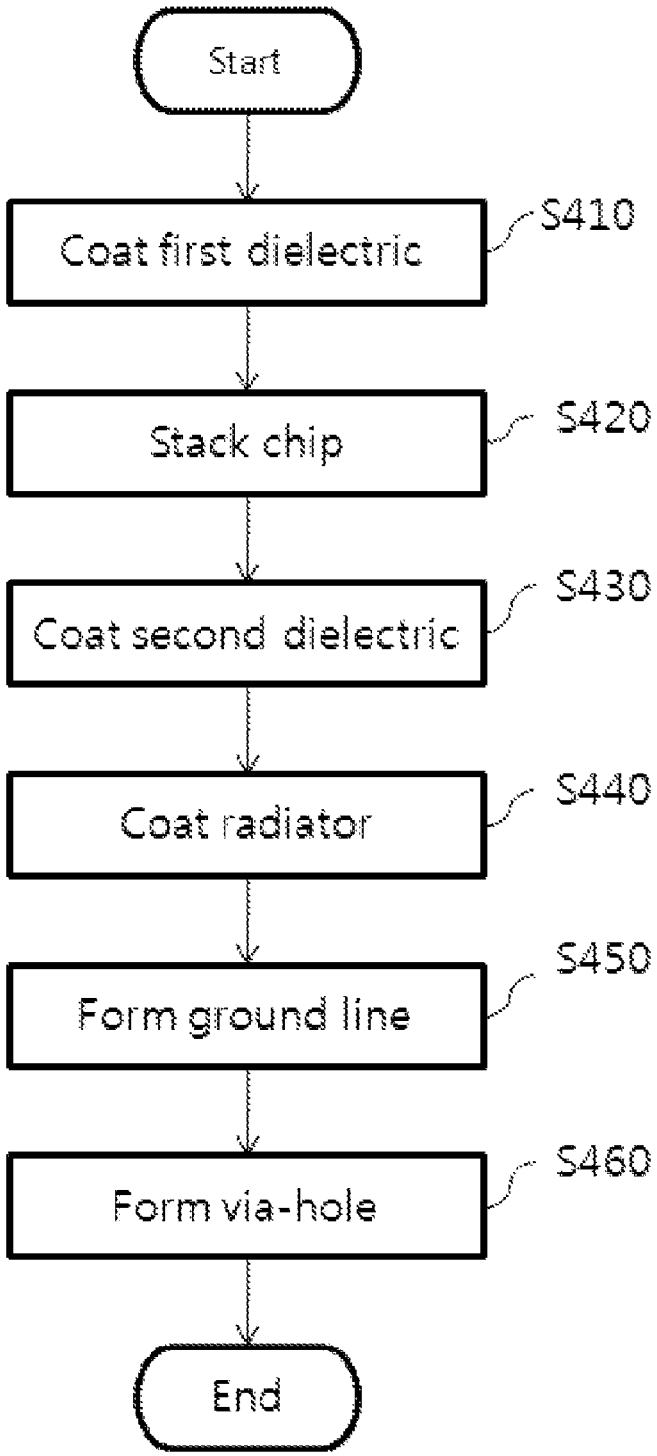
FIG. 4 is a flow chart illustrating a method of manufacturing the antenna of FIG. 2.

FIG. 4 is a flow chart illustrating a method of manufacturing the antenna using a buildup structure of FIG. 2. With reference to FIG. 4, in step S410, a first dielectric 21 is applied to an upper surface of a ground 27 forming of a conductor. In step S420, a chip 31 is stacked on an upper surface of the first dielectric 21 as applied in the step S410. In step S430, a second dielectric 23 is applied to the upper surface of the first dielectric 21, to enclose the chip 31.

In step S440, a radiator 25 is applied to an upper surface of the second dielectric 23, and in step S450, a ground line 29 passing through the first dielectric 21 and the second dielectric 23 is formed to connect the radiator 25 and the ground 27. In step S460, a via-hole 33 passing through the second dielectric 23 is formed to connect the radiator 25 and input/output terminals of the chip 31.

The steps S450 and S460 may be changed in sequence. In the via-hole 33 formed in the step S460, for example, a conductor may be printed on an inside of the via-hole 33, or the via-hole 33 may be filled with a conductor.

Figure 5:
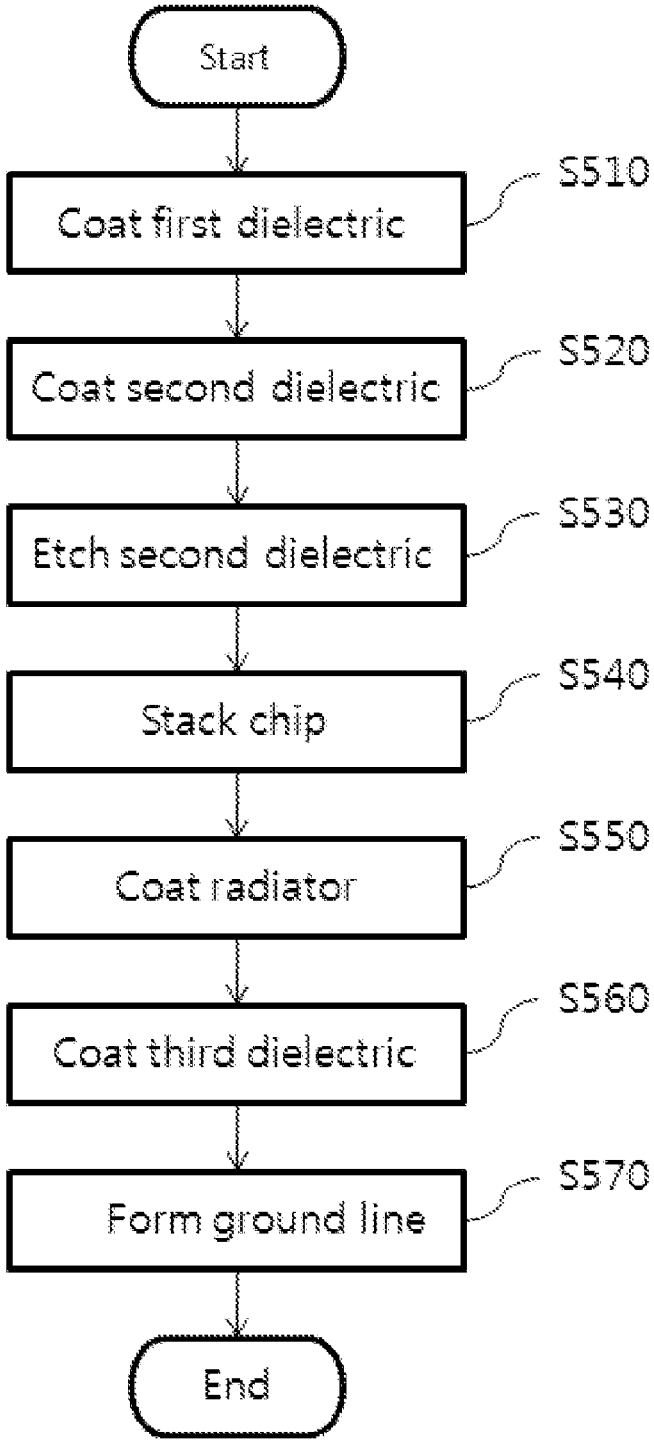
FIG. 5 is a flow chart illustrating a method of manufacturing the antenna of FIG. 3.

FIG. 5 is a flow chart illustrating a method of manufacturing the antenna using a buildup structure of FIG. 3. With reference to FIG. 5, in step S510, a first dielectric 21 is applied to an upper surface of a ground 27 forming of a conductor. In step S520, a second dielectric 23 is applied to an upper surface of the first dielectric 21.

Subsequently, in step S530, a middle part of the second dielectric 23 applied in the step S520 is etched, and in step S540, a chip 31 is stacked on the part etched in the step S530.

In step S550, a radiator 25 is applied to an upper surface of the second dielectric 23, so as to be connected to a connection line 35 of the chip 31. In step S560, a third dielectric 24 is applied to the part which is etched in the step S530 and where the chip 31 is stacked in the step S540.

In step S570, the radiator 25 and the ground 27 form a ground line 29 passing through the first dielectric 21 and the second dielectric 23. The steps S570 and S560 may be changed to each other in sequence.

In the antenna using a buildup structure according to the present invention, since a tag chip is positioned within a dielectric, the antenna is designed to be less affected by external environments. The antenna using a buildup structure according to the present invention is able to be used in various fields, such as products, traffic, security and safety, among others. Specially, the antenna using a buildup structure can be used by being positioned within a metal or liquid.

As described above, in accordance with the present invention, the antenna is manufactured to be strong and durable against the external environments, such as impact, static electricity, temperature, pressure, humidity and the like, to minimize its malfunction and defective rate and to be used for the special purpose of being positioned within a metal or liquid.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

What is claimed is:

1. An antenna using a buildup structure, comprising:

a dielectric layer including a first dielectric, and a second dielectric stacked on the first dielectric;

a radiator positioned on an upper surface of the dielectric layer;

a ground positioned at an under surface of the dielectric layer;

a ground line connecting the radiator and the ground; and a chip positioned within the second dielectric, wherein the dielectric layer includes at least one via-hole to connect input/output terminals of the chip and the radiator.

2. The antenna according to claim 1, wherein the first dielectric and the second dielectric consist of the same material.

3. The antenna according to claim 1, wherein the first dielectric and the second dielectric consist of different materials.

4. The antenna according to claim 1, wherein the at least one via-hole is printed with a conductor.

5. The antenna according to claim 1, wherein the at least one via-hole is filled with a conductor.

6. An antenna using a buildup structure, comprising:

a dielectric layer including a first dielectric, a second dielectric stacked on the first dielectric, and a third dielectric positioned amid the second dielectric and stacked on the first dielectric;

a radiator positioned on an upper surface of the dielectric layer;

a ground positioned at an under surface of the dielectric layer;

a ground line connecting the radiator and the ground;

a chip positioned within the third dielectric; and a connection line connecting the chip and the radiator.

7. The antenna according to claim 6, wherein one or more of the first, second and third dielectrics consist of different materials.

8. A method of manufacturing an antenna using a buildup structure, the method comprising:

coating a first dielectric on an upper surface of a ground formed of a conductor;

stacking a chip on an upper surface of the first dielectric;

coating a second dielectric on the upper surface of the first dielectric on which the chip is stacked;

coating a radiator on an upper surface of the second dielectric; and forming a ground line passing through the first and second dielectrics, to connect the radiator and the ground, and forming at least one via-hole passing through the second dielectric, to connect the radiator and input/output terminals of the chip.

9. The method according to claim 8, wherein the first dielectric and the second dielectric consist of the same material.

10. The method according to claim 8, wherein the first dielectric and the second dielectric consist of different materials.

11. The method according to claim 8, wherein the radiator is connected with the input/output terminals of the chip by printing a conductor.

12. The method according to claim 8, wherein the radiator is connected with the input/output terminals of the chip by filling a conductor.

13. A method of manufacturing an antenna using a buildup structure, the method comprising:

coating a first dielectric on an upper surface of a ground formed of a conductor;

coating a second dielectric on an upper surface of the first dielectric;

etching a middle part of the second dielectric and stacking a chip on the etched part of the second dielectric;

coating a radiator on an upper surface of the second dielectric so that the radiator is connected to a connection line of the chip;

coating a third dielectric on the part where the chip is stacked; and forming a ground line passing through the first and second dielectrics to connect the radiator and the ground.

14. The method according to claim 13, wherein one or two of the first, second and third dielectrics consist of different materials.

* * * * *